US007232296B2

(12) United States Patent
Sato et al.

(10) Patent No.: US 7,232,296 B2
(45) Date of Patent: Jun. 19, 2007

(54) SERVICEABILITY FEATURES FOR A SCROLL FLUID MACHINE

(75) Inventors: Toru Sato, Yokohama (JP); Tamotsu Fujioka, Yokohama (JP)

(73) Assignee: Anest Iwata Corporation (JP)

( * ) Notice: Subject to any disclaimer, the term of this patent is extended or adjusted under 35 U.S.C. 154(b) by 53 days.

(21) Appl. No.: 11/073,823

(22) Filed: Mar. 7, 2005

(65) Prior Publication Data

US 2005/0220648 A1 Oct. 6, 2005

(30) Foreign Application Priority Data

Mar. 30, 2004 (JP) ..... 2004-099076

(51) Int. Cl.
*F04C 29/04* (2006.01)

(52) U.S. Cl. ..... 418/55.2; 418/55.1; 418/85

(58) Field of Classification Search ..... 418/55.1, 418/55.2, 85

See application file for complete search history.

(56) References Cited

U.S. PATENT DOCUMENTS 4,435,136 A * 3/1984 Terauchi et al. ..... 418/55.1
4,514,150 A * 4/1985 Hiraga et al. ..... 417/440
5,290,160 A * 3/1994 Ito et al. ..... 418/55.1
5,622,487 A * 4/1997 Fukuhara et al. ..... 418/55.2
6,139,292 A * 10/2000 Kimura ..... 418/55.3
6,302,658 B1 * 10/2001 Seipel et al. ..... 417/269
6,461,129 B2 * 10/2002 Liu ..... 418/55.2

FOREIGN PATENT DOCUMENTS

JP 2001-123969 5/2001

OTHER PUBLICATIONS

Eugene A. Avallone and Theodore Baumeister III, Mark's Standard Handbook for Mechanical Engineers—10th Edition, Copyright 1996, Publisher: McGraw-Hill; pp. 6-12, and 5-3.*

* cited by examiner

*Primary Examiner*—Thomas Denion
*Assistant Examiner*—Mary A. Davis

(57) ABSTRACT

A scroll fluid machine comprises an orbiting scroll and a stationary scroll. The orbiting scroll comprises an orbiting end plate having an orbiting wrap, and the stationary scroll comprises a stationary end plate having a stationary wrap. The orbiting scroll is supported to turn on an eccentric shaft portion of a drive shaft. The orbiting wrap engages with the stationary wrap to form a sealed chamber therebetween. A bearing tube is detachably disposed in a housing. The drive shaft is supported to turn in the bearing tube.

14 Claims, 3 Drawing Sheets

SERVICEABILITY FEATURES FOR A SCROLL FLUID MACHINE

BACKGROUND OF THE INVENTION

The present invention relates to a scroll fluid machine such as a scroll compressor, a scroll vacuum pump, a scroll expander or a scroll blower.

Such a scroll fluid machine comprises an orbiting scroll having an orbiting end plate and supported to turn on an eccentric shaft portion of a drive shaft via a bearing, and a stationary scroll having a stationary end plate. An orbiting wrap of the orbiting end plate engages with a stationary wrap of the stationary end plate to form a sealed chamber between the orbiting and stationary wraps. The scroll fluid machine has a self-rotation preventing mechanism for preventing rotation of the orbiting scroll.

By the eccentric shaft portion of the drive shaft and the self-rotation preventing mechanism, the orbiting scroll is eccentrically revolved. Depending on a revolving direction, the volume in the sealed chamber gradually decreases toward a center or increase away from the center, thereby compressing fluid sucked from the outer circumference toward the center or depressurizing fluid sucked from the center to discharge it through the outer circumference.

A housing of the scroll fluid machine is generally manufactured by die casting of Al alloy. During operation, a support portion for a ball bearing thermally expands to decrease holding force of the support portion, so that the ball bearing is likely to rotate in the support portion.

To prevent it, a cast iron reinforcement ring is cast into the support portion to restrain thermal expansion of the support portion and to increase strength thereof. However, the whole housing is made by die casting of Al alloy to limit restraint of thermal expansion of the support portion and not to achieve it sufficiently.

Furthermore, the reinforcement ring separately made of different material must be cast surely and firmly during die casting of Al alloy to obtain suitable product, which requires excellent technique and the increased number of steps to increase a total cost.

SUMMARY OF THE INVENTION

To overcome the disadvantages in the prior art, it is an object of the present invention to provide a scroll fluid machine in which a housing is made of Al alloy by die casting, to fit with different bearings or a drive shaft having different length of a bearing support portion, having a drive-shaft support portion that can be replaced if it is damaged or inoperative to assure long-time operation suitably.

BRIEF DESCRIPTION OF THE DRAWINGS

The above and other features and advantages of the invention will become more apparent from the following description of embodiments as shown in appended drawings wherein.

DETAILED DESCRIPTION OF PREFERRED EMBODIMENT

Figure 4:
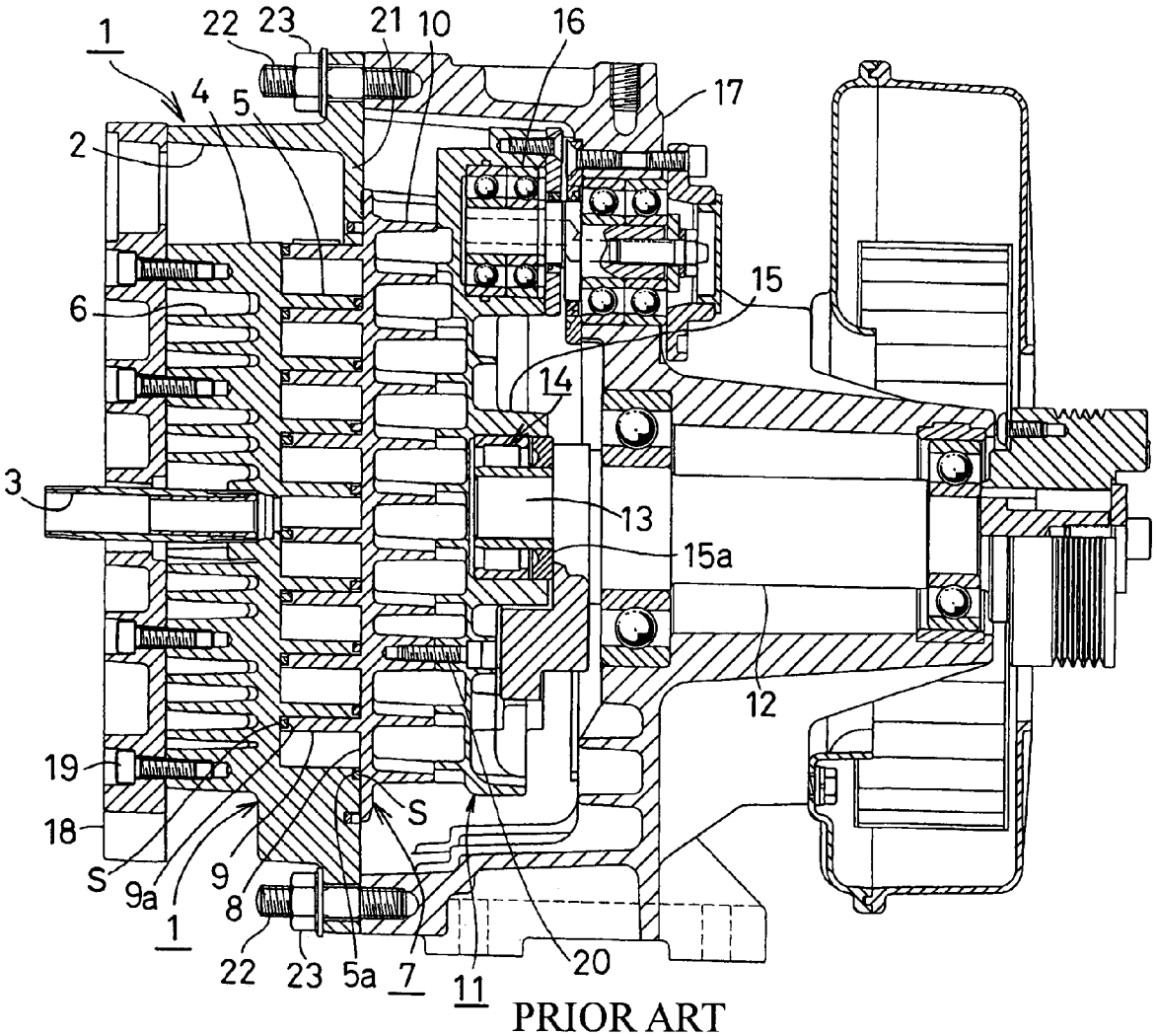
FIG. 4 is a vertical sectional side view of a known scroll fluid machine.

FIG. 4 shows an example of a known scroll compressor. The basic structure in FIG. 4 is known and will simply be described. In FIG. 4, the left side is front, and the right side is rear.

In a stationary scroll 1 at the left or front side in FIG. 4, a circular stationary end plate 4 has a sucking bore 2 on the outer circumference and a discharge bore 3 at the center. A spiral stationary wrap 5 is provided on the rear surface of the stationary end plate 4 and a plurality of horizontal corrugated cooling fins 10 are provided at regular intervals on the front surface.

An orbiting scroll 7 behind the stationary scroll 1 has a circular orbiting end plate 8 which has a spiral orbiting wrap 9 on the front surface opposite to the stationary scroll 1 and a plurality of corrugated cooling fins 10 at regular intervals on the rear surface.

Behind the orbiting scroll 7, a bearing plate 11 is provided. In the central portion of the rear surface of the bearing plate 11, there is provided a tubular boss 15 in which an eccentric shaft portion 13 of a drive shaft 12 is supported to turn on a roller bearing 14. At three points on the outer circumference of the bearing plate 11, there is a known crank-pin-type self-rotation preventing mechanisms 16 so that the orbiting scroll 7 may eccentrically revolve around the drive shaft 12 in a housing 17.

A cover plate 18 contacts the front surface of the stationary scroll 1 and is fixed by a screw 20.

The orbiting scroll 7 is fixed to the bearing plate 11 by a screw on the rear side of the orbiting scroll 7. A rear plate 21 of the stationary scroll 1 contacts the front surface of the housing 17 and is fixed to the housing 17 by a bolt 22 and a nut 23.

Engagement grooves 5*a* and 9*a* are formed on the ends of the stationary wrap 5 and the orbiting wrap 9 respectively. In the engagement grooves 5*a* and 9*a*, seal members "S" in sliding contact with the orbiting end plate 8 of the orbiting scroll 7 and the stationary end plate 4 of the stationary scroll 1 are provided respectively. The orbiting wrap 9 is similar thereto in structure.

The stationary scroll 1, the orbiting scroll 7, the housing 17 and the cover plate 18 are all made of Al alloy by die casting.

Figure 1:
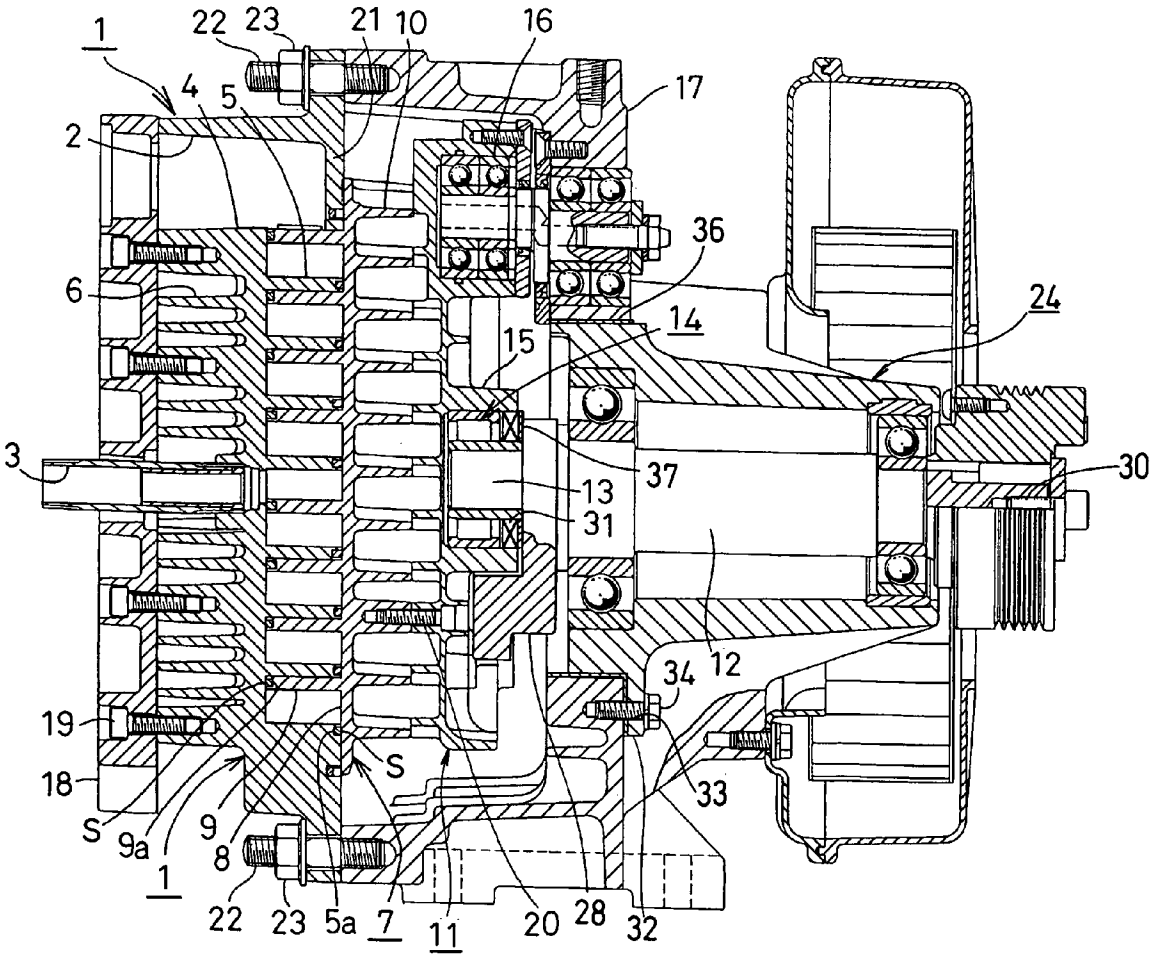
FIG. 1 is a vertical sectional side view of a scroll fluid machine according to the present invention.
Figure 2:
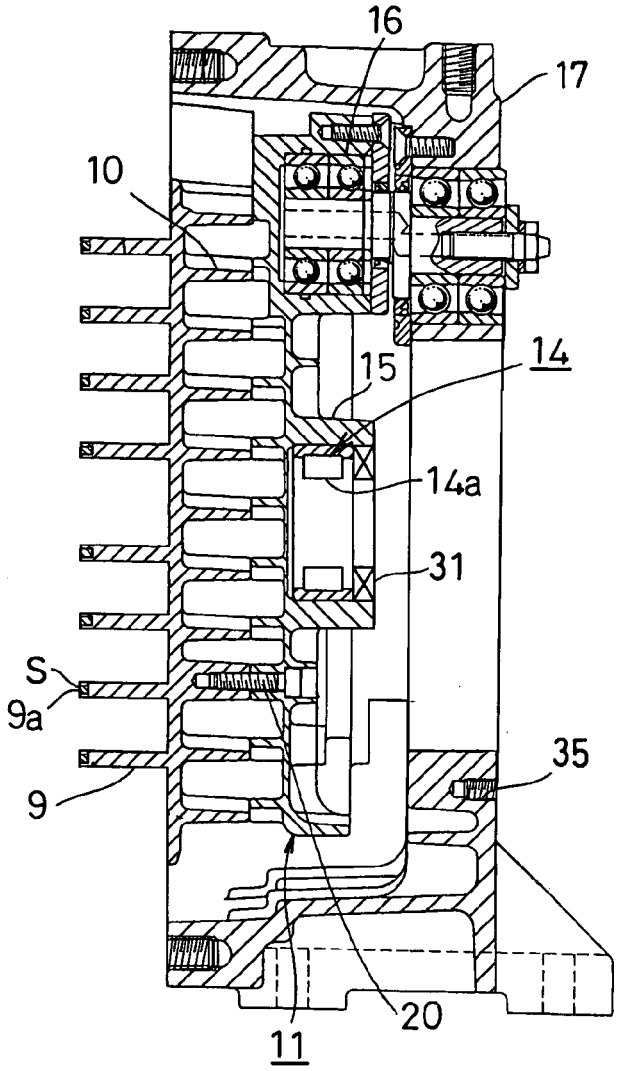
FIG. 2 is a vertical sectional side view of a housing of the scroll fluid machine in FIG. 1.
Figure 3:
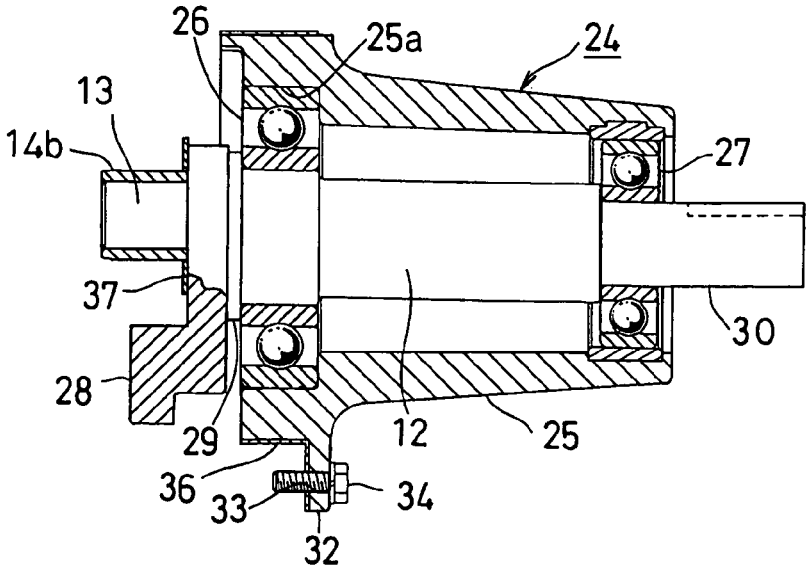
FIG. 3 is a vertical sectional side view of a bearing unit of the scroll fluid machine in FIG. 1.

The foregoing structure is general as a scroll fluid machine,

The present invention will be described with respect to FIGS. 1 to 3, and a bearing unit 24 that supports an eccentric shaft portion 13 of a drive shaft 12 to turn thereon is separately made of different material from that of a housing 17.

A bearing tube 25 of the bearing unit 24 is made of material such as cast iron providing higher strength and lower thermal expansion coefficient than that of the housing. The bearing tube 25 is detachable from the rear of the housing 17 and has ball bearings 26,27 at the front and rear ends of the bearing tube 25. The drive shaft 12 is supported by the ball bearings 26,27 to turn thereon.

Between the eccentric shaft portion 13 and the drive shaft 12, a balance weight 28 is provided. The drive shaft 12 is provided via a collar 29 behind the balance weight 28 and has a smaller-diameter portion 30 at the rear end.

An oil seal 31 is provided on the eccentric shaft portion 13 in front of the balance weight 28. The front ball bearing 26 engages on the drive shaft 12 right behind the collar 29 and is supported in an engagement groove 25*a* at the front end of the bearing tube 25. The rear ball bearing 27 engages on the front end of the smaller-diameter portion 30 and is supported on the rear end of the bearing tube 25. Thus, the drive shaft 12 is prevented from going out of the bearing tube 25 rearward.

The eccentric shaft portion 13 of the drive shaft 12 projects from the front surface of the bearing tube 25. A plurality of rollers 14*a* of a roller bearing 14 engage in a tubular boss 15 of the housing 17. An inner race 14*b* in the plurality of rollers 14*a* contacts the eccentric shaft portion 13. An oil seal 31 is provided on an opening end of the tubular boss 15.

The smaller-diameter portion 30 at the rear end of the drive shaft 12 projects from the rear end of bearing tube 25. On the projected smaller-diameter portion 30, a rotation drive for transmitting driving force such as a key, an engagement joint or a pulley is provided.

At the front end of the bearing tube 25, a plurality of ears 32 are formed. A screw 34 goes through a thread bore 33 of each of the ears 32 and is threaded in a female bore 35 of the housing 17, so that the bearing unit 24 is detachably mounted to the rear surface of the housing 17. The eccentric shaft portion 13 is supported to turn in the roller bearing 14.

The shape, the number and location of the bearings for supporting the drive shaft 12 in the bearing tube 25 are optional.

At contacting portion of the bearing unit 24 and the housing 17, such as between the ear 32 and the housing 17 and between the drive shaft 12 and the tubular boss 15, thermal insulation packings 36,37 are inserted to prevent transfer of heat. Thermal insulation coating may be applied instead of the thermal insulation packing.

The foregoing merely relates to an embodiment of the invention. Various modifications and changes may be made by persons skilled in the art without departing from the scope of claims wherein:

What is claimed is:

1. A scroll fluid machine comprising:

a housing having a hole at one side;

a drive shaft passing through the hole of the housing and having an eccentric shaft portion at one end in the housing;

an orbiting scroll supported on the eccentric shaft portion to turn via a bearing in the housing and comprising an orbiting end plate having an orbiting wrap;

a stationary scroll comprising a stationary end plate having a stationary wrap that forms a sealed chamber with the orbiting wrap;

a self-rotation preventing mechanism for preventing the orbiting scroll from rotating on its own axis in the housing;

a bearing unit that comprises a bearing tube one end of which puts in an inner circumferential surface of the hole of the housing to allow the bearing tube to be detachably secured to the housing, and a bearing which rotatably supports the drive shaft in the bearing tube; and a heat insulator disposed between the inner circumference of the hole of the housing and an outer circumference of the bearing tube.

2. A scroll fluid machine as claimed in claim 1 wherein the drive shaft is disposed in the bearing tube via a ball bearing.

3. A scroll fluid machine as claimed in claim 1 wherein the bearing tube is fixed by threading a bolt into the housing.

4. A scroll fluid machine as claimed in claim 1 wherein the bearing tube is madeof material having thermal expansion coefficient lower than that of the housing.

5. A scroll fluid material as claimed in claim 1 wherein the bearing tube is made of material having mechanical strength higher than that of the housing.

6. A scroll fluid machine as claimed in claim 1 wherein the housing is made of Al alloy while the bearing tube is made of cast iron.

7. A scroll fluid machine as claimed in claim 1 wherein a thermal insulation packing is put between the bearing tube and the housing.

8. A scroll fluid machine as claimed in claim 1 wherein a thermal insulation coating is put between the bearing tube and the housing.

9. A scroll fluid machine as claimed in claim 1 wherein the heat insulator comprises a thermal insulation packing.

10. A scroll fluid machine as claimed in claim 1 wherein the heat insulator extends between a rear surface of the housing and the bearing tube.

11. A scroll fluid machine comprising:

a housing having a hole at one side;

a drive shaft passing through the hole of the housing and having an eccentric shaft portion at one end in the housing;

an orbiting scroll supported on the eccentric shaft portion to turn via a bearing in the housing and comprising an orbiting end plate having an orbiting wrap;

a stationary scroll comprising a stationary end plate having a stationary wrap that forms a sealed chamber with the orbiting wrap;

a bearing plate fixed to the orbiting scroll and having a tubular boss;

a self-rotation preventing mechanism for preventing the orbiting scroll from rotating on its own axis in the housing;

a bearing unit that comprises a bearing tube one end of which puts in an inner circumferential surface of the hole of the housing to allow the bearing tube to be detachably secured to the housing, and a bearing which rotatably supports the drive shaft in the bearing tube; and a heat insulator disposed between a vertical part of the drive shaft and the tubular boss of the bearing plate.

12. A scroll fluid machine as claimed in claim 11 wherein the drive shaft further comprises a balance weight, the heat insulator being disposed between the tubular boss of the bearing plate and a front surface of the balance weight.

13. A scroll fluid machine as claimed in claim 11 wherein the housing is made of Al alloy while the bearing tube is made of cast iron.

14. A scroll fluid machine as claimed in claim 11 wherein the heat insulator comprises a thermal insulation packing.

* * * * *